US005298932A

United States Patent [19]

Twist

[11] Patent Number: 5,298,932

[45] Date of Patent: Mar. 29, 1994

[54] METHOD FOR REPLENISHING PHOTOGRAPHIC DEVELOPER SOLUTIONS

[75] Inventor: Peter J. Twist, Bucks, United Kingdom

[73] Assignee: Eastman Kodak Company, Rochester, N.Y.

[21] Appl. No.: 931,056

[22] Filed: Aug. 17, 1992

[30] Foreign Application Priority Data

Aug. 21, 1991 [GB] United Kingdom ..... 9118007

[51] Int. Cl.[5] ..... G03D 3/02

[52] U.S. Cl. ..... 354/324

[58] Field of Search ..... 354/324; 134/64 P, 122 P

[56] References Cited

U.S. PATENT DOCUMENTS 5,057,858 10/1991 Woog ..... 354/324

OTHER PUBLICATIONS

Abstract No. 5286652 (WPI Acc. No. 89-208317/29).

Abstract No. 4059705 (WPI Acc. No. 86-063096/10).

*Primary Examiner*—D. Rutledge

*Attorney, Agent, or Firm*—Nixon, Hargrave, Devans & Doyle

[57] ABSTRACT

A method is provided for replenishing a Photographic developer solution in a processing apparatus which includes a developer tank, a developer-addition reservoir, and a replenishment station. The method is characterized in that developer-addition solution sufficient for an extended Period of time is contained in the developer-addition reservoir and fed to the developer tank at a rate higher than the standard replenishment rate for the process being operated, while the overflow from the developer tank is fed to the replenishment station where, at the end of said extended period, it is replenished to account for chemical consumption for the whole extended period and then returned to the reservoir.

9 Claims, 2 Drawing Sheets

METHOD FOR REPLENISHING PHOTOGRAPHIC DEVELOPER SOLUTIONS

Figure 1:
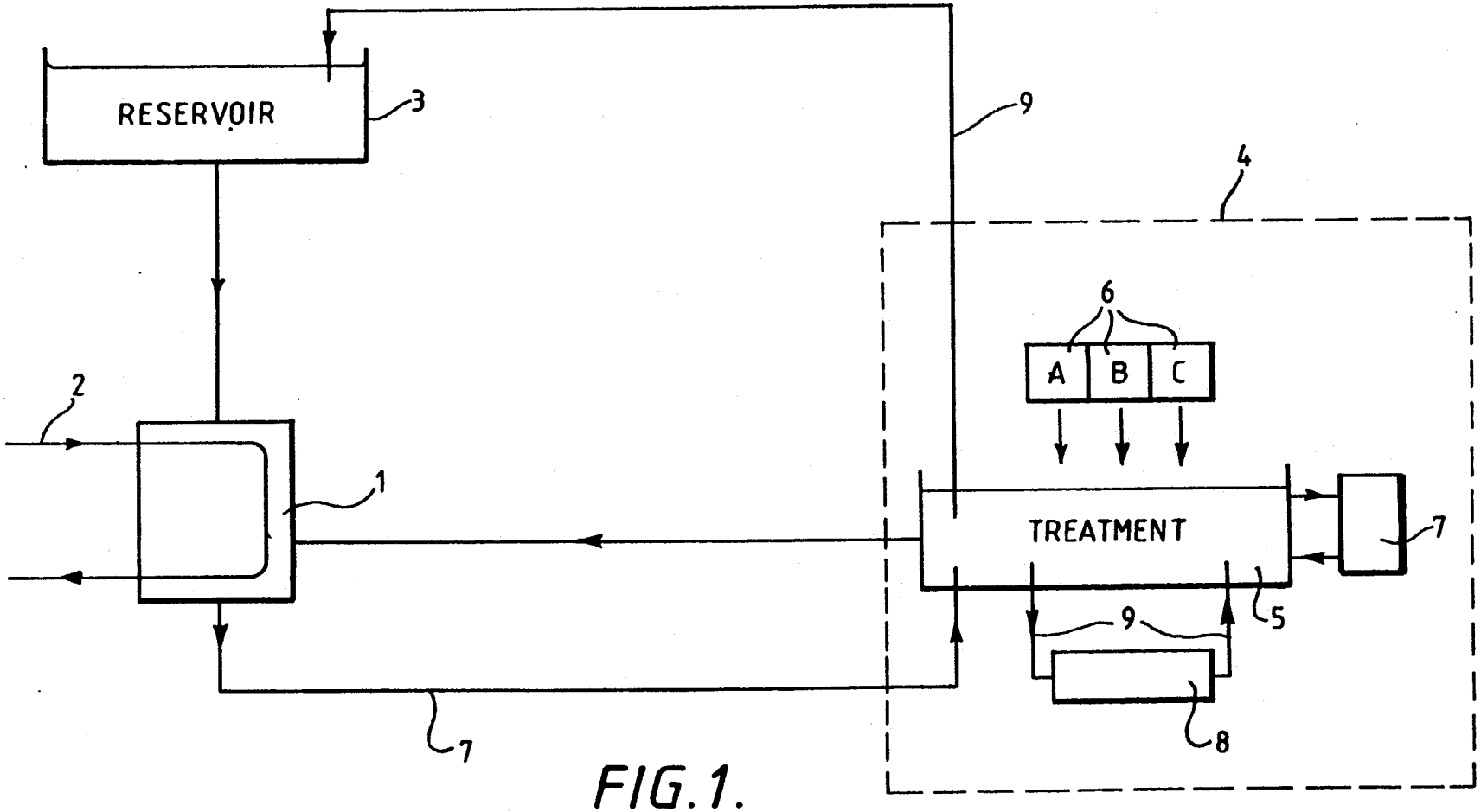

This invention relates to a method for replenishing photographic developer solutions applicable to black and white or color materials, film or paper.

It is well known that when a photographic developing process is run under continuous or semi-continuous conditions, there is a need to replenish the processing solution to replace components used in the process or lost by, for example, aerial oxidation. There is a continuing need to improve such processes, inter alia, as far as the cost of the process, the quality of the product produced and the environmental acceptability of any effluent.

Of recent years replenishment rates have dropped but this in turn means that the exact amount of replenisher used becomes more critical and difficult to control so as to obtain consistent results.

It has been proposed to replenish developers with relatively concentrated replenishers so as to achieve zero overflow thus avoiding the need to dispose of developer bath overflow. It is, however, even more difficult to control this process sufficiently well to achieve the desired consistency of results.

The object of the present invention is to provide a method of developer replenishment which provides well controlled uniformity of product, ease of working and minimum environmental load.

According to the present invention there is provided a method of replenishing a photographic developer solution in a processing apparatus which includes a developer tank characterized in that the apparatus also comprises a developer-addition reservoir and a replenishment station and in that developer-addition solution sufficient for an extended period of time is contained in the developer-addition reservoir and fed to the developer tank at a rate higher than the standard replenishment rate for the process being operated, while the overflow from the developer tank is fed to the replenishment station where, at the end of said extended period, it is replenished to account for chemical consumption for the whole of said extended period and then returned to the reservoir.

In a preferred embodiment of the present invention the amount and concentration of the replenisher is such that no overall overflow is caused.

The developer-addition solution can, in one embodiment, be the same composition as the standard developer solution in the developer tank if the volume added per unit area of film or paper is large enough so that any seasoning products, such as halide ion, or image-forming chemicals such as color developing agent do not change in concentration sufficiently to cause a noticeable change in sensitometric response. Such a procedure is a standard method for production testing of sensitized materials where the 'replenisher' is actually the same composition as the developer and added at 7 to 10 times the rate of a normal replenisher. A standard replenisher is more concentrated than the developer by an amount appropriate to the volume of replenisher being added.

However, when the developer-addition solution is added to the developer at a rate of 10 times the normal replenishment rate then, for color negative processing, there will be a finite amount of seasoning and chemical consumption. This will only cause a barely noticeable change in photographic response as processing progresses through the day. Although this amount of seasoning and chemical consumption is small it is finite and can be calculated. The composition of the developer-addition solution in a second embodiment of the present invention is slightly different from the developer composition such that seasoning and chemical consumption caused by processing of sensitized material is exactly balanced. The preferred addition rate would still be high at 5 to 10 times the normal replenishment rate. In this embodiment the overflow collected will be developer solution and will be passed to the replenishment station where it is converted back to the developer-addition solution composition. In an example of such an embodiment the developer solution would be:

| Developer Solution | |
|---|---|
| Sodium hydroxide | 24.50 |
| Sodium bromide | 1.30 |
| 4-(N-ethyl-N-2-hydroxyethyl)-2-methylphenylene diamine | 4.50 |
| Potassium sulphate | 5.01 |
| Hydroxylamine sulphate | 2.00 |
| Potassium sulphate | 4.80 |
| Diethyltriamine-pentaacetic acid | 6.50 |
| Potassium carbonate | 37.50 |
| Water to | 1.0 liter |
| pH = 10.00 | |

The normal replenishment rate is 20.5 ml per linear meter or 35 mm film, while the developer solution would be:

| Developer-Addition Solution | |
|---|---|
| Sodium hydroxide | 24.61 |
| Sodium bromide | 1.22 |
| 4-(N-ethyl-N-2-hydroxyethyl)-2-methylphenylene diamine | 4.65 |
| Potassium sulphate | 5.15 |
| Hydroxylamine sulphate | 2.09 |
| Potassium sulphate | 4.80 |
| Diethyltriamine-pentacetic acid | 6.50 |
| Potassium carbonate | 37.50 |
| Water to | 1.0 liter |
| pH = 10.03 | |

The developer-addition solution would be added at 203 ml per linear meter of 35 mm film, i.e., 10 times the normal replenishment rate.

The replenishment station preferably further comprises means for removing unwanted developer seasoning products, for example, halide ions and oxidized developer.

In a particularly convenient embodiment, the extended period corresponds to one day's working so that the replenishment is done once a day. After replenishment it is convenient to process a test strip to confirm that the replenishment has been correct. Naturally other time intervals such as half a day or more, e.g. two or three days, could be chosen.

The advantages of the present process are:

1. The film or paper is processed under "flooded conditions" of higher than normal replenishment (which is often done for reference purposes) thus achieving highly consistent processing.

2. The overall replenishment rate can be very low and this would be difficult to control in a conventional system due to the small quantities that would have to be added accurately.

3. Time dependent replenishment is easy to achieve and low utilization conditions can be managed.

4. Replenishment is only carried out once per extended period hence can be done accurately because the volumes involved are comparatively large.

5. One control strip only is required in each extended period instead of more frequently.

6. There is the minimum environmental load for a given developer composition.

7. The system is equally applicable to paper or film processing, black and white or color.

8. The system is applicable to developer formulations of all kinds regardless of their actual composition.

Sometimes when a group of films are all predominantly over or under exposed, the average replenishment amount would be inappropriate. In order to deal with such situations as well as low utilization situations, the preferred technique would be to under-replenish, process a test strip and then add further replenisher in calculated amounts if this appeared necessary from the processed test strip.

The replenishment station comprises a tank for storing the overflow solution from the developer tank, means for storing and adding replenisher compounds either singly or grouped. Means are provided to return the replenished solution to the reservoir. In preferred embodiments there are also means for removing unwanted developer seasoning products from the solution. Such means may be ion-exchange resins and membranes of the anionic, cationic or amphoteric type and/or a dialysis, electrodialysis, or reverse osmosis unit.

The materials to be processed and the developer solutions employed may be any of the photographic materials and developer compositions described in Research Disclosure Item 308119, December 1989 published by Kenneth Mason Publications, Emsworth, Hants, United Kingdom.

In some cases it may be unnecessary to remove halide ions whereas in other cases this would be essential. For example, when using the present process in the development of the color negative film Kodak® VRG100, removal of bromide ions is not necessary. When processing pure silver chloride materials, for example color papers, again no halide removal is necessary.

The rate at which the developer-addition solution is added to the developer tank may be from 3 to 15 times the standard replenishment rate, preferably from 5 to 10 times.

Figure 2:
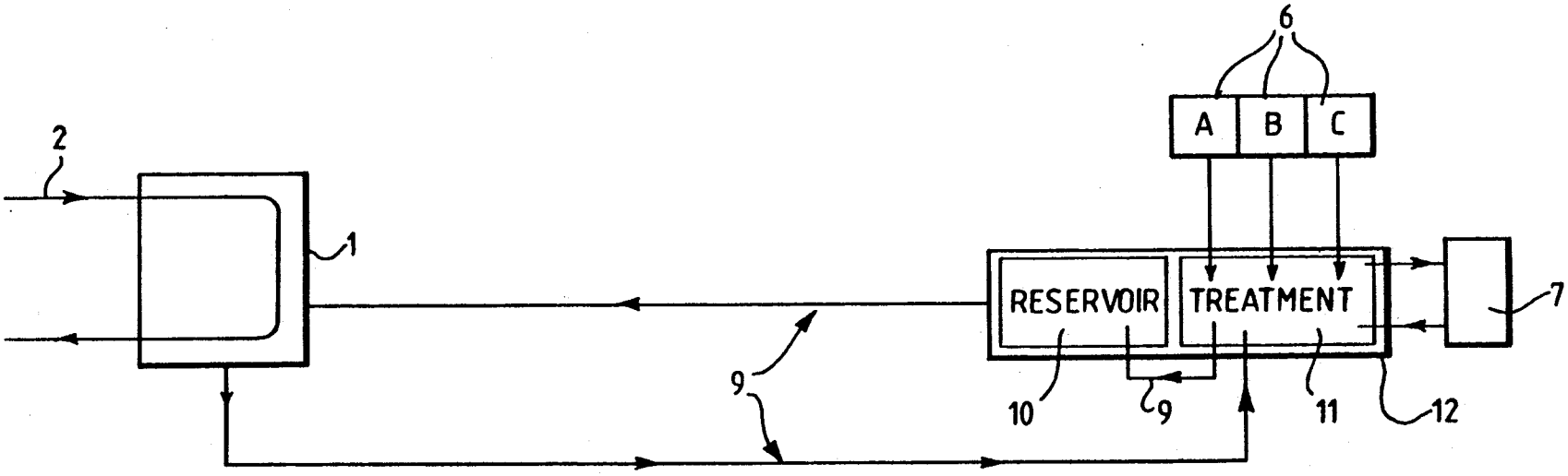

In the accompanying drawings:

FIGS. 1 and 2 are schematic diagrams showing embodiments of the apparatus employed to carry the present invention into effect.

In FIG. 1 there is illustrated in a schematic way, apparatus for carrying out a preferred embodiment of the present invention. The apparatus comprises a developer tank (1) through which photographic film or paper (2) can be transported, a reservoir (3), and a treatment station (4) comprising a treatment tank (5), vessel holding replenisher concentrates (6), an ion-exchange column (7) and a dialysis unit (8). The various parts are connected with piping (9) provided with pumps (not shown) where necessary. It is preferred to control the operation of the replenishment system using a microprocessor.

The two tanks (3) and (5) can be made of any material but are preferably compressible plastic "bag-in-a-box" tanks. Since the volume of the total system is constant, the space taken up by both tanks is also constant, hence both bags may be housed in the same box.

If it is desired to work to an extended period of one working day, in designing the apparatus it is necessary to calculate the desired volume of the reservoir (3), treatment tank (5) and developer tank (1) which, of course, needs to be comparatively small. This will depend on the rate of replenishment and the amount of film or paper processed in one day. For example, processing Kodak® VRG100 color negative film by the C41 low replenishment (LORR) system usually requires replenishment at the rate of 20.3 ml per linear meter (ml/m) of 35 mm film. The rate for a zero overflow system would be about 2 ml/m, i.e. about a tenth of the conventional rate.

Since the volume of the total system is constant and the space taken up by both tanks is correspondingly constant both bags may be located in the same box. Such a configuration is shown in FIG. 2 in which the reservoir (10) and treatment tank (11) are collapsible bags located in a container (12). As bag (10) becomes smaller, bag (11) becomes larger but the total volume remains constant.

In the present invention the replenishment would, for example, be at ten times the normal rate (or 100 times the zero overflow rate). Assuming a typical day's processing amounts to 19 36-exposure films per hour over an eight hour period (and this corresponds to maximum usage in some machines), the volume of the reservoir needs to be:

$$19 \times 5 \times 62.5 \times 8/1000 = 47.4 \text{ liters.}$$

I claim:

1. A method of replenishing a photographic developer solution in a processing apparatus which comprises a developer tank containing developer tank solution, comprising:

maintaining a quantity of developer-addition solution sufficient for an extended period of time in a developer-addition reservoir;

adding the developer-addition solution to the developer tank solution at a rate higher than the standard replenishment rate for the process being operated to produce overflow from the developer tank, conveying the overflow from the developer tank to a replenishment station, adding a replenisher to the overflow in the replenishment station at the end of the extended period to account for chemical consumption during the extended period to produce the developer-addition solution, and returning the developer-addition solution to the developer-addition reservoir.

2. A method according to claim 1, wherein the developer-addition solution and the developer tank solution are of substantially the same composition.

3. A method according to claim 1, further comprising balancing the composition of the developer-addition solution to compensate for seasoning effects and chemical consumption resulting from processing of sensitized material such that the composition of the developer tank solution does not change.

4. A method according to claim 1, wherein the amount and concentration of the replenisher are such that no overall overflow is caused.

5. A method according to claim 1, wherein the replenishment station comprises means for removing unwanted developer seasoning products.

6. A method according to claim 5, wherein the means comprise an ion-exchange column and/or a dialysis unit.

7. A method according to claim 1, wherein the rate at which developer-addition solution is fed from the reservoir to the developer tank is from 3 to 5 times the standard rate of replenishment.

8. A method according to claim 2, wherein the rate at which developer-addition solution is fed form the reservoir to the developer tank is from 3 to 5 times the standard rate of replenishment.

9. A method according to claim 1, wherein the extended period is one working day.

* * * * *

UNITED STATES PATENT AND TRADEMARK OFFICE

CERTIFICATE OF CORRECTION

PATENT NO. : 5,298,932

DATED : March 29, 1994

INVENTOR(S) : Twist

It is certified that error appears in the above-indentified patent and that said Letters Patent is hereby corrected as shown below:

In the Abstract, line 1, delete "Photographic" and insert --photographic--.
In the Abstract, line 6, delete "Period" and insert --period--.
In Column 6, line 1, delete "3 to 5 times" and insert --3 to 15 times--.
In Column 6, line 4, delete "form" and insert --from--.
In Column 6, line 5, delete "3 to 5 times" and insert --5 to 10 times--.

Signed and Sealed this

Twenty-third Day of August, 1994

*Attest:*

Bruce Lehman

BRUCE LEHMAN

*Attesting Officer*

*Commissioner of Patents and Trademarks*